US005885116A

United States Patent [19]

Byfield, Jr.

[11] Patent Number: 5,885,116

[45] Date of Patent: Mar. 23, 1999

[54] ELECTRICAL CONNECTOR

[75] Inventor: Dwight Byfield, Jr., Fresno, Calif.

[73] Assignee: WirthCo Engineering Co., Bloomington, Minn.

[21] Appl. No.: 808,815

[22] Filed: Feb. 28, 1997

[51] Int. Cl.[6] ..... H01R 4/48

[52] U.S. Cl. ..... 439/759; 439/789

[58] Field of Search ..... 439/759, 761, 439/762, 763, 764, 789, 816, 822, 834, 835

[56] References Cited

U.S. PATENT DOCUMENTS

| | | | |
|---|---|---|---|
| 899,708 | 9/1908 | Ball | 439/789 |
| 4,479,694 | 10/1984 | Cornell et al. | 439/789 |
| 5,290,646 | 3/1994 | Asao et al. | 439/762 |
| 5,716,243 | 2/1998 | Kourimsky | 439/761 |

FOREIGN PATENT DOCUMENTS 2524721 10/1983 France .

*Primary Examiner*—Neil Abrams
*Assistant Examiner*—T C Patel
*Attorney, Agent, or Firm*—Roger W. Jensen

[57] ABSTRACT

An electrical connector for securing an electrical connection between a conductor and a wire or cable, comprises a first plate, a second plate below the first plate, a hinge attaching the rear portion of the first plate to the rear portion of the second plate, and a wire securing means attached to one of the plates. The first and second plates have tabs attached to their forward portions, and each plate has at least one hole therethrough, the holes being sized to receive a conductor. The hinge allows the forward portion of the second plate to be moved relative to the forward portion of the first plate. Means are provided for biasing the two plates to a closed position, where the holes on the first and second plates are not aligned. In the open position, the holes are aligned. When a conductor is extended through the holes in the open position, the bias means biases the plates toward the closed position to firmly retain the conductor.

9 Claims, 1 Drawing Sheet

ELECTRICAL CONNECTOR

BACKGROUND OF THE INVENTION

This invention relates to an improved electrical connector that firmly secures an electrical connection between a conductor and an electrical wire.

Electrical connectors are commonly used to secure an electrical connection between a conductor, such as the terminal post of a battery, and an electrical wire or cable. The ability to secure and retain a firm electrical connection is a desirable property of an electrical connector. A secure connection is necessary to prevent the unintentional release of the conductor and the consequent breakage of the electrical circuit. This is particularly true for connections to automobile batteries, where a loose connection can cause starting problems.

Locking security mechanisms for electrical connectors are commercially available. However, these mechanisms often involve numerous interlocking components and are thus difficult to assemble and difficult and time-consuming to install. Furthermore, the cost of manufacturing numerous interlocking components makes the electrical connector expensive to purchase.

Thus, there is a need for an electrical connector that can maintain an electrical connection secure, that is relatively inexpensive, and that is simple to assemble and use.

SUMMARY OF THE INVENTION

The present invention provides an electrical connector that satisfies these needs. The connector described herein maintains a secure connection between a conductor and wire, is relatively inexpensive, and does not have a multitude of components.

The electrical connector of the present invention comprises two generally parallel plates, a first or top plate and a second or bottom plate. Each plate has a hole therethrough, the holes being of substantially the same size and shape. The plates have a forward portion and a rear portion, with the rear portions of the two plates being joined together by hinge means. The hinge allows the forward portion of the plates to be moved relative to each other so that the electrical connector can adopt the conformation of a "closed" position or a "open" position.

When the connector is in the closed position, the holes in the two plates are not aligned so that the electrical conductor cannot extend through both holes. When the electrical connector is in the open position, the two holes are aligned so that the conductor can extend through both holes.

The connector also includes means biasing the plates to the closed position so that once the conductor is placed in the two holes, it is firmly retained therein as the plates try to move toward the closed, non-aligned position. The electrical connector also includes means for securing a wire to one of the plates.

In a preferred version of the invention, at least one, but preferably both, of the plates has a tab on a side edge to aid in moving the plates to the open position, merely by pressing on the tabs. For this purpose, preferably the tab on the first plate is opposed to the tab on the second plate.

In the preferred embodiment of the invention, the wire securing means is an elongate cavity, the cavity sized to receive an electrical wire. When the walls of the cavity are crimped, the electrical wire is firmly grasped therewithin.

In a preferred version of the invention, the two plates have at least two holes sized to fit conductors of different sizes. It is also preferred to fabricate the entire connector including the top and bottom plates, the hinge, and the wire securing means from a single strip of flexible material such as phosphorous-bronze.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE INVENTION

Figure 1:
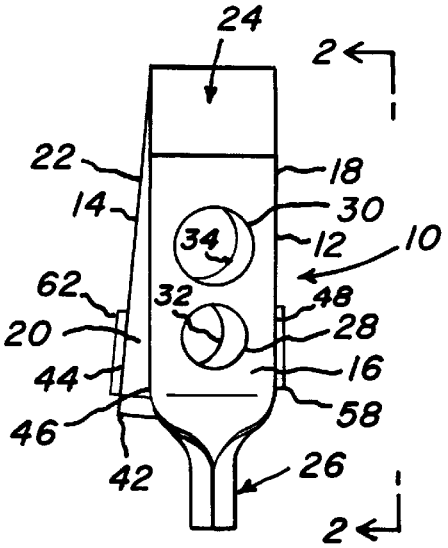
FIG. 1 is a top plan view of an electrical connector according to the present invention, in the closed position.

With reference to the figures, an electrical connector 10 according to the present invention comprises a first or top plate 12 and a second or bottom plate 14 (the "top" and "bottom" designations are provided merely as a convenient method of distinguishing between the two plates). The plates are substantially parallel to each other, are contiguous, and are substantially the same in length, width and thickness. The top plate 12 has a forward portion 16 and a rear portion 18, and likewise the bottom plate 14 has a forward portion 20 and a rear portion 22. The rear portion 18 of the top plate 12 is attached to the rear portion 22 of the bottom plate 14 by a hinge 24. A wire connector 26 is attached to one of the plates, and preferably to the forward portion 16 of the top plate 12.

The top plate 12 has a plurality of holes, comprising a first hole 28 and a second hole 30, and the bottom plate 14 has a plurality of holes, comprising a first hole 32 and a second hole 34. The size and shape of the first holes 28 and 32 are substantially the same, and the size and shape of the second holes 30 and 34 are substantially the same. The first and second holes preferably are differently sized to receive conductors of different sizes; or, they can be the same size to allow the connector to simultaneously connect two similarly sized conductors.

Figure 6:
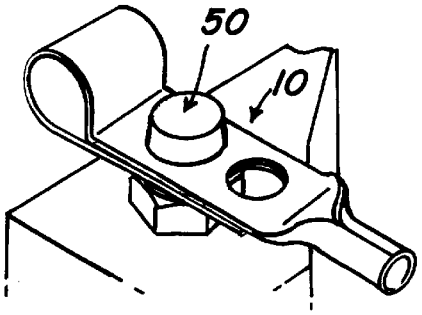
FIG. 6 is a perspective view of the connector of FIG. 5 fitted onto the terminal post.

In the preferred embodiment of the invention, the hinge 24 is a loop, oval in cross-section, with a straight forward portion 36 and a curved rear portion 38. The straight forward portion 36 is attached to the rear portion 18 of the top plate 12. The curved rear portion 38 is attached to the rear portion 22 of the bottom plate 14. The hinge allows the forward portion 20 of the bottom plate 14 to move or pivot relative to the forward portion 16 of the top plate 12 in the plane of the plates. This is necessary to align the holes 28 and 30 in the top plate 12 with the holes 32 and 34 in the bottom plate 14. When the holes of the top plate 12 and the holes of the bottom plate 14 are not aligned, the plates are defined to be in their "closed position." In the closed position of the preferred version of the invention, the longitudinal axis of the top plate 12 is offset from the longitudinal axis of the bottom plate 14. In the "open position," the holes 28 and 32 are aligned and the holes 30 and 34 are aligned, allowing the connector 10 to be fitted onto a conductor 50 as shown in FIG. 6.

Means 40 are provided for biasing the two plates to the closed position, so that the conductor 50, when inserted through a hole in each plate, is firmly retained by the connector. In the closed position, the top plate 12 is not aligned with the bottom plate 14, and a corner 42 and a side edge 44 of the forward portion of the bottom plate 14, extend beyond the corresponding side edge 46 of the top plate 12; and another side edge 48 and another corner 52 of the forward portion of the top plate 12 extend beyond the corresponding side edge 54 of the bottom plate.

Figure 4:
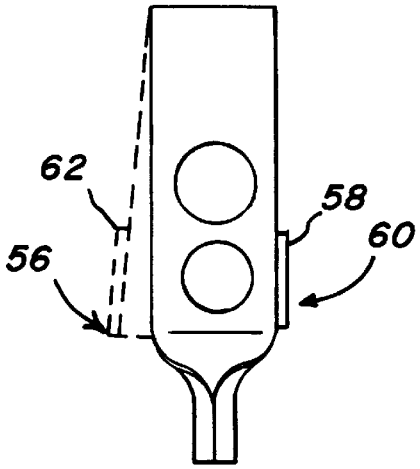
FIG. 4 is a top plan view of the connector of FIG. 1 in the open position.
Figure 5:
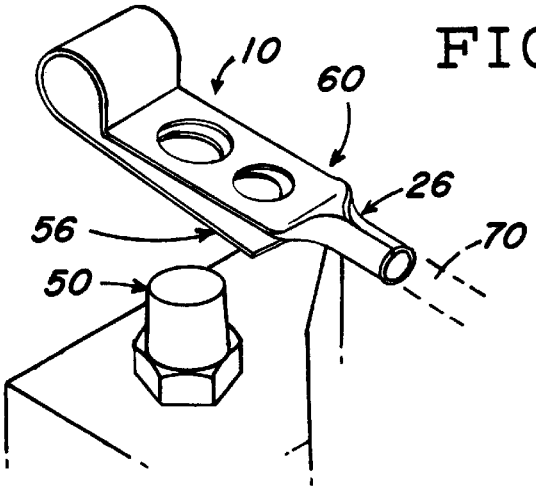
FIG. 5 is a perspective view of the connector of FIG. 1 showing the connector in relationship to a typical conductor such as the terminal post of a battery, and showing the movement of the forward position of the bottom plate to align the holes on the top and bottom plates, in the open position of the connector.

A tab 58 perpendicular to the plane of the top plate 12 is attached to the forward portion 16 of the top plate 12 on the side 48 thereof; and a tab 62 perpendicular to the plane of the bottom plate 14 is attached to the forward portion 20 of the bottom plate 14 on the side 44 thereof, which is opposed to the side 48 of the top plate having a tab. When a force 56 is applied to tab 62 and an opposing force 60 is applied to tab 58, the holes on the top and bottom plates can be aligned, as shown in FIG. 4. When a conductor is inserted through the aligned holes and the force aligning the plates is released, the biasing means biases the bottom plate 14 toward the closed position so that the connector 10 firmly retains the conductor 50, as shown in FIG. 6. In the preferred version of the invention, the hinge means 24 and the biasing element 40 are the one and same element.

Figure 2:
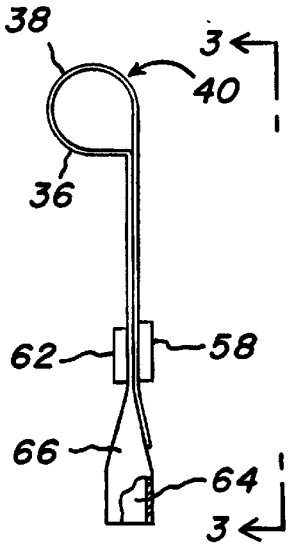
FIG. 2 is a side elevation view of the connector of FIG. 1 taken on line 2—2 in FIG. 1.
Figure 3:
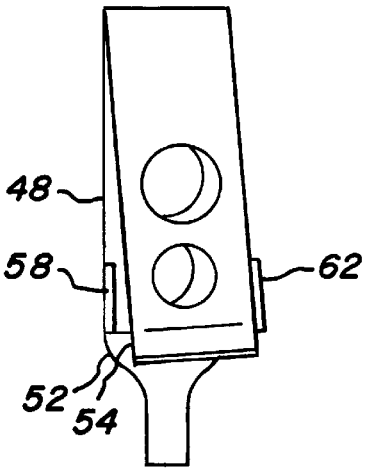
FIG. 3 is a bottom plan view of the connector of FIG. 1 taken on line 3—3 in FIG. 2.

The wire connector 26 is an elongated cavity 64 with side walls 66, as shown in FIG. 2. The cavity 64 is sized to receive an electrical wire. When the side walls 66 are crimped onto a wire 70, the side walls firmly grasp the electrical wire.

Other versions of the wire connector are possible. For example, the connector can have a plurality of wire securing means to connect a multitude of wires onto a single connector. The wire connector can also be a stud or threaded bolt attached to one of the plates, the bolt sized to fit ring shaped wire terminals. The wire connector can also be a small hole through one of the plates, the hole sized to fit wire terminals comprising of a stud or nut and bolt.

In the preferred embodiment of the invention the top plate 12, the bottom plate 14, the hinge 24, the biasing means 40, and the wire connector 26 are all fabricated from a single strip of flexible and resilient material. The flexible and resilient material can be an electrically conductive metal such as copper, steel, aluminum, silver, gold; or an alloy such as bronze or phosphorus bronze; or a flexible polymer such as nylon or plastic. of these materials, phosphorus bronze alloy is preferred because this material retains its shape after numerous loading cycles and is electrically conductive. Thus, if the hinge 24 is fabricated from phosphorus bronze, the connector 10 can be used numerous times without substantial deformation of the hinge.

The connector of the present invention can be fabricated on a punch-press, by punching or stamping out a shape corresponding to the unfolded outline of the entire connector including the top and bottom plates, the tabs on the top and bottom plates, the hinge means, the wire securing means and the biasing means. The holes through the top and bottom plates are also punched out; either simultaneously or in a separate punching step.

The punched-out shape is then bent and shaped to form the connector. The tabs attached to the top and bottom plates are formed by bending a strip of metal adjacent to the plate to form a tab which is perpendicular to the plate. The hinge means can be formed by folding the top plate over the bottom plate in a circular form.

The wire connector 26 can be formed by bending a portion of the punched-out shape into a hollow, elongate cylinder. Another form of a wire connector can be formed by welding or soldering a threaded bolt or stud onto one of the metal plates. A third type of wire connector can be fabricated by punching a hole through one of the plates, the hole sized to fit the bolt of a nut and bolt electrical terminal.

The biasing means may be built into the punched-out shape by punching the plates offset to one another. When the plates are subsequently folded over to create top and bottom plates, the built-in offset creates the biasing force.

Alternatively, the punched out shape can be first folded over to create top and bottom plates, and then the plates can be twisted to bias the two plates to the closed position. When hardened phosphorous bronze alloy is used to fabricate the connector, the alloy must be heated to a temperature above the annealing temperature of the alloy prior to bending the plates. The bent plates must be then heated to a temperature in excess of the annealing temperature of the alloy, to re-harden the alloy.

The present invention provides several advantages over existing connectors. First, the connector forms a secure connection between a conductor and an electrical wire. Thus, the invention can be used to secure an electrical wire to:

(i) a battery terminal, (ii) a prong connected to an electrical circuit, or (iii) the lead wire of an electrical component.

Second, unlike other securing mechanisms, the present invention involves a single component assembly and is consequently much easier and quicker to use than securing mechanisms with multiple components.

Third, the method of assembling and using the connector to firmly secure an electrical connection is simple. Complex instructions on the method of assembling and using the connector are not necessary.

A fourth advantage of the present invention is the low cost of the connector. The connector can be fabricated from a single strip of metal or polymer. The simplicity of its design avoids complex machining and shaping processes.

A fifth advantage of the invention is that a single connector with multiple holes can fit conductors of different sizes. This flexibility is especially useful when the same connector is regularly used on conductors of different sizes.

Although the present invention has been described in considerable detail with reference to certain preferred versions thereof, other versions are possible. Therefore the spirit and scope of the appended claims should not be necessarily limited to the description of the preferred versions containing herein.

What is claimed is:

1. An electrical connector for connecting an electrical conductor to a wire, the connector comprising:

(a) a first elongated plate having a planar shape and a longitudinal axis, a rear portion and a forward portion having a hole therethrough, the hole being sized to receive an electrical conductor;

(b) a second elongated plate having a planar shape and a longitudinal axis and positioned generally parallel with contiguous to said first plate, the second plate having a rear portion and a forward portion having a hole therethrough, the size and shape of the two holes being substantially the same and slightly larger than the electrical conductor;

(c) hinge means joining the rear portion of the first plate to the rear portion of the second plate so that the forward portion of the first plate can be moved generally in the plane of the first plate relative to the forward portion of the second plate from a closed position to an open position, said longitudinal axes being non-parallel in said closed position and parallel in said open position, wherein the hole of the second plate is not aligned with the hole of the first plate in the closed position so that the electrical conductor cannot extend through both holes; and wherein the hole of the second plate is aligned with the hole of the first plate in the open position so that the conductor can extend through both holes;

(d) means biasing the plates to the closed position so that when the conductor is inserted in the two holes it is firmly retained in the plates; and (e) means for securing a wire to the connector.

2. The electrical connector of claim 1 fabricated from a single strip of flexible and resilient material.

3. The electrical connector of claim 2, wherein the flexible and resilient material is a phosphorous bronze alloy.

4. The electrical connector of claim 1, wherein each plate has first and second holes therethrough, the first holes are of the same size and shape and aligned in the open position and not aligned in the closed position, and the second holes are of the same size and shape and aligned in the open position and not aligned in the closed position.

5. The electrical connector of claim 1, wherein the hinge means comprises a curved member.

6. The electrical connector of claim 5 wherein the biasing means is the curved member.

7. The electrical connector of claim 1 wherein at least one of plates has a tab on an edge to aid in moving the plates to the open position.

8. The electrical connector of claim 1 wherein the first plate has a tab on one of its edges and the second plate has an opposed tab on one of its edges to aid in moving the plates to the open position.

9. An electrical connector comprising:

(a) a first plate having a rear portion, a forward portion, side edges, a tab substantially perpendicular to the plane of the first plate attached to one of the side edges thereof, and first and second holes therethrough, the first and second holes being sized to receive conductors of different sizes;

(b) a second plate substantially parallel and contiguous to to the first plate, the second plate having a rear portion, a forward portion, side edges, a tab opposed to the tab on the first plate, the tab on the second plate being attached to one of the side edges of the second plate, and first and second holes therethrough, wherein the first holes are of the same size and shape and the second holes are of the same size and shape, wherein the second holes are smaller in diameter than the first holes, and wherein the longitudinal axis of the first plate is laterally offset from the longitudinal axis of the second plate so that the holes of the second plate are not aligned with the holes of the first plate;

(c) a wire securing means for securing a wire to the connector, the wire securing means comprising walls defining an elongate cavity sized for receiving an electrical wire, wherein the walls of the cavity can be crimped to firmly clasp a wire therein; and (d) a hinge means joining the rear portion of the first plate to the rear portion of the second plate so that the forward portion of the first plate can be moved relative to the forward portion of the second plate from a closed position to an open position, wherein the holes of the second plate are not aligned with the holes of the top plate in the closed position so that the electrical conductor cannot extend through both holes, wherein the first hole of the second plate is aligned with the first hole of the first plate in the open position so that the conductor can extend through both holes; and wherein the hinge biases the plates to the closed position so that when the conductor is placed in the aligned holes it is firmly retained in the plates.

* * * * *